US008981736B2

(12) United States Patent
Dunipace

(10) Patent No.: US 8,981,736 B2
(45) Date of Patent: Mar. 17, 2015

(54) HIGH EFFICIENCY, THERMALLY STABLE REGULATORS AND ADJUSTABLE ZENER DIODES

(75) Inventor: Richard A. Dunipace, Highland Village, TX (US)

(73) Assignee: Fairchild Semiconductor Corporation, San Jose, CA (US)

( * ) Notice: Subject to any disclaimer, the term of this patent is extended or adjusted under 35 U.S.C. 154(b) by 347 days.

(21) Appl. No.: 13/285,127

(22) Filed: Oct. 31, 2011

(65) Prior Publication Data

US 2012/0105027 A1 May 3, 2012

Related U.S. Application Data

(60) Provisional application No. 61/408,879, filed on Nov. 1, 2010.

(51) Int. Cl.
*G05F 1/46* (2006.01)

(52) U.S. Cl.
USPC ..... 323/247; 323/282; 323/907

(58) Field of Classification Search
USPC ..... 323/222, 225, 231, 266, 267, 271, 275, 323/282–288, 311–316, 906, 907, 246, 323/247; 363/16–20, 21.01, 21.18, 53, 55, 363/65, 124; 330/254, 283, 311
See application file for complete search history.

(56) References Cited

U.S. PATENT DOCUMENTS 4,352,056 A * 9/1982 Cave et al. ..... 323/314
4,764,716 A * 8/1988 Sturzl ..... 323/231
5,304,946 A * 4/1994 Sano et al. ..... 330/254
5,387,822 A * 2/1995 Martin-Lopez et al. ..... 307/125
5,414,340 A 5/1995 Gannon
5,621,307 A 4/1997 Beggs
6,046,578 A * 4/2000 Feldtkeller ..... 323/314
6,903,945 B2 6/2005 Kitano
7,005,838 B2 * 2/2006 Tobita ..... 323/314
7,196,501 B1 3/2007 Dunipace (Continued)

FOREIGN PATENT DOCUMENTS

CN 2400814 Y 10/2000
CN ZL2011204261303 7/2012
CN 102541140 A 8/2012

OTHER PUBLICATIONS

"Chinese Application Serial No. 201110338155.2, Office Action mailed Jul. 30, 2013", 12 pgs.

(Continued)

*Primary Examiner* — Rajnikant Patel
(74) *Attorney, Agent, or Firm* — Schwegman Lundberg & Woessner, P.A.

(57) ABSTRACT

This document discusses, among other things, apparatus for high-efficiency, thermally-compensated regulators. In an example, a regulator can include a zener diode having a first temperature coefficient, the zener diode configured couple to an output and to provide at least a portion of a reference voltage, a transistor having a second temperature coefficient, the transistor configured to receive the reference voltage, to receive a representation of the output, and to provide feedback information indicative of an error of the output using the representation of the output voltage and the reference voltage, and wherein the first temperature coefficient and the second temperature coefficient are configured to reduce at least a portion of a temperature drift effect of the zener diode and the transistor.

13 Claims, 7 Drawing Sheets

(56) References Cited

U.S. PATENT DOCUMENTS

| | | | | |
|---|---|---|---|---|
| 7,200,016 | B2 | 4/2007 | Ogawa | |
| 8,184,419 | B2 * | 5/2012 | Peng | 361/93.9 |
| 2004/0145924 | A1 | 7/2004 | Jang et al. | |
| 2004/0190311 | A1 | 9/2004 | Sakai | |
| 2005/0040885 | A1 | 2/2005 | Hayashi | |
| 2008/0170417 | A1 | 7/2008 | Yang | |
| 2011/0026277 | A1 | 2/2011 | Strijker | |
| 2012/0281439 | A1 | 11/2012 | Polivka et al. | |
| 2013/0187619 | A1 | 7/2013 | Dunipace | |
| 2013/0229833 | A1 | 9/2013 | Tai et al. | |

OTHER PUBLICATIONS

"U.S. Appl. No. 13/544,157, Non Final Office Action mailed Mar. 18, 2014", 34 pgs.

"Chinese Application Serial No. 201110338155.2, Office Action mailed May 12, 2014", w/English Translation, 12 pgs.

"Chinese Application Serial No. 201110338155.2, Response filed Feb. 14, 2014 to Office Action mailed Jul. 30, 2013", w/English Claims, 13 pgs.

* cited by examiner

HIGH EFFICIENCY, THERMALLY STABLE REGULATORS AND ADJUSTABLE ZENER DIODES

CLAIM OF PRIORITY

This patent application claims the benefit of priority, under 35 U.S.C. Section 119(e), to Dunipace, U.S. Provisional Patent Application Ser. No. 61/408,879, entitled "HIGH EFFICIENCY, THERMALLY STABLE REGULATORS AND ADJUSTABLE ZENER DIODES," filed on Nov. 1, 2010, which is hereby incorporated by reference herein in its entirety.

BACKGROUND

Electric utilities have recently begun to monitor customer power usage using "smart" electrical meters. In addition to the overall amount of energy consumed at a location, the smart meters can monitor the quality of the energy and the particular time when the energy was used. The information can be used to more accurately bill a customer. In addition, the smart meters can transmit the energy information to a central location without the need for personnel to observe the meter. In certain examples, the smart meter may require 8 watts to transmit the energy information. When not transmitting, the smart meter may only use 0.25 watts of power. Typical power supply regulators can use 48 milliwatts (mW) or more of power. During non-transmission times, the regulator may use about 20% of the meter power. This is wasted energy. This wasted energy is characteristic of other devices that monitor conditions during standby, such as devices that can be used with a remote control. Significant energy savings can be realized with more efficient power supply regulators.

OVERVIEW

This overview is intended to provide an overview of subject matter of the present patent application. It is not intended to provide an exclusive or exhaustive explanation of the invention. The detailed description is included to provide further information about the present patent application.

This document refers to, among other things, apparatus for high-efficiency, thermally-compensated regulators. In an example, a regulator can include a zener diode having a first temperature coefficient, the zener diode configured couple to an output and to provide at least a portion of a reference voltage, a transistor having a second temperature coefficient, the transistor configured to receive the reference voltage, to receive a representation of the output, and to provide feedback information indicative of an error of the output using the representation of the output voltage and the reference voltage, and wherein the first temperature coefficient and the second temperature coefficient are configured to reduce at least a portion of a temperature drift effect of the zener diode and the transistor.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
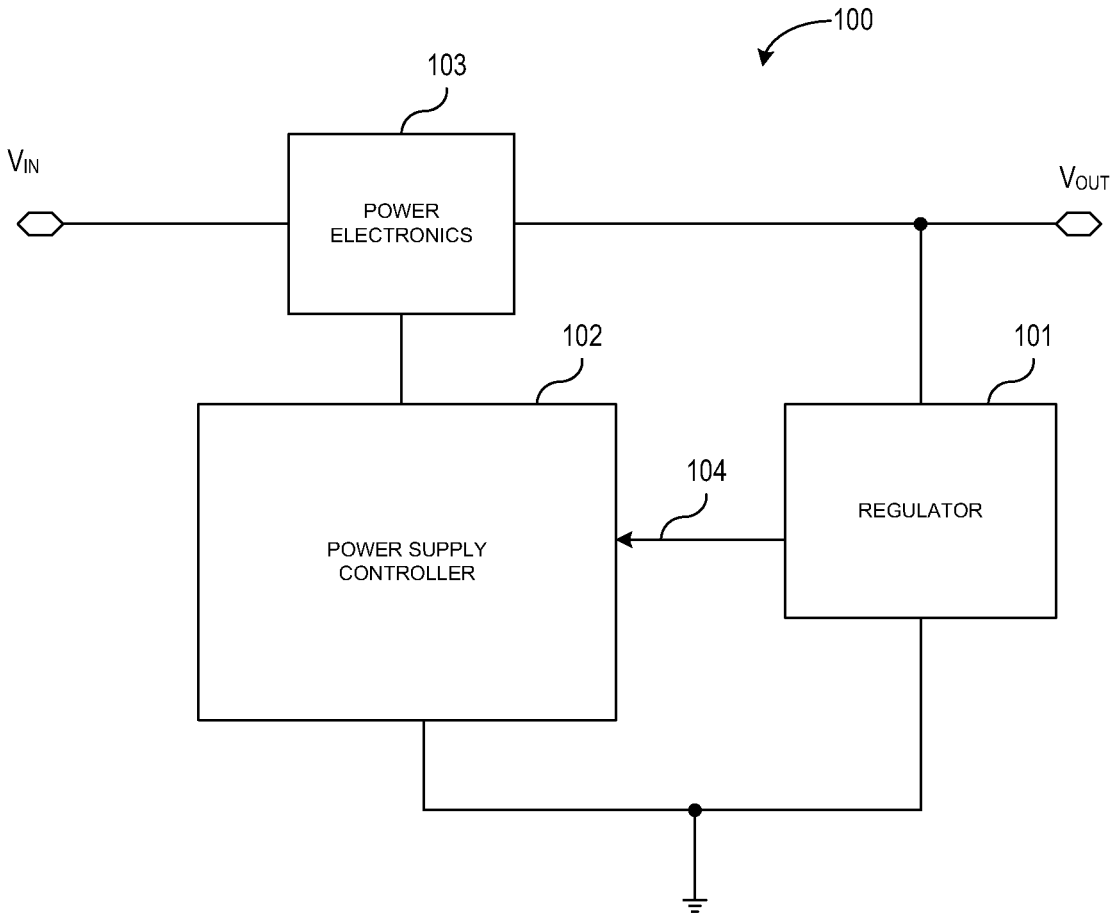
FIG. 1 illustrates generally a power supply including a high-efficiency, thermally stable regulator.

Power levels for smart meters can range between 1 watt (W) and 15 W. Non-smart meters can have power levels of around 1 W. In certain examples, smart meter specifications can allow continuous transmission of energy information so the power supplies need to be dimensioned for the high power levels used during transmission. In certain examples, a smart meter can use about 0.25 watts between transmissions for housekeeping. (~99% of the time). Power that is used by a secondary power supply regulator can significantly impact the overall efficiency of the power supply during housekeeping intervals. Traditional regulators can require 1 mA worst-case keep-alive, plus 0.5 to 1 mA for the reference divider, plus any current needed for an optical isolator if the regulator is isolated. Overall, this can amount to 48 mW. In power supplies with low power outputs such as 250 mW output this can amount to ~19.2% power loss.

The present inventor has recognized, among other things, example zener-based regulators including thermal compensation based upon a thermal gradient of a transistor junction such as the base-emitter thermal gradient of a BJT transistor, to provide a high quality, thermally stable, low-current references at low power and price. Example regulators can use only a few milliwatts in certain examples and are capable of significantly improving overall efficiency of power supplies used in low power applications.

In certain examples, a high-efficiency regulator can use less than 6.24 mW. (At 250 mW output ~3% loss). If 10 million smart meters are installed using a high-efficiency regulator, the power saving can be around 500,000 watts.

FIG. 1 illustrates generally a block diagram of a power supply 100 including an example high-efficiency regulator 101. The power supply 100 can include a power supply controller 102, power electronics 103, and the regulator 101. In certain examples, the power supply controller 102 and the power electronics 103 can include fly back topologies, buck topologies, half bridge drivers, full bridge driver, power factor correction (PFC) controllers, pulse width modulation (PWM) controllers, resonant type topologies or combinations thereof. In an example, the power supply controller 102 can include a pulse width modulated controller and the power electronics 103 can include one or more power switches, rectifiers, isolation components, or combinations thereof. The power supply 100 can receive an input voltage $V_{IN}$ at the power electronics 103. The power supply controller 102 can provide command signal to control the power electronics 103 to provide a desired output voltage $V_{OUT}$ or current. In certain examples, the regulator 101 can compare the output voltage $V_{OUT}$ to a reference (not shown) and can provide feedback information 104 to the power supply controller 102. The power supply controller 102 can modify the control of the power electronics 103 to correct any output voltage or current error received in the feedback information 104.

Figure 2:
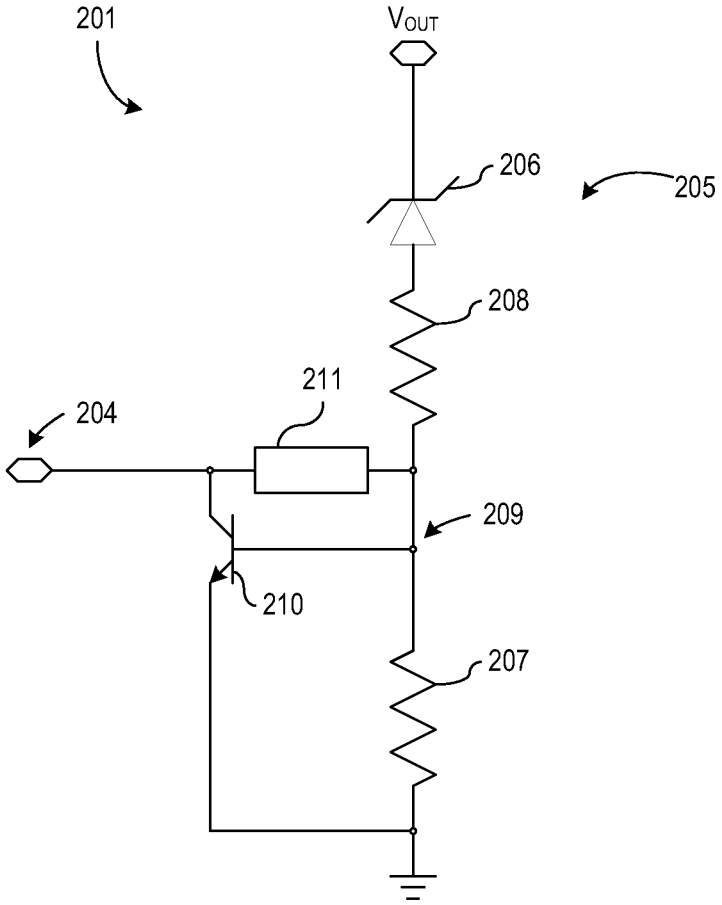
FIG. 2 illustrates generally an example inverting, non-isolated, high-efficiency, thermally-compensated regulator.

FIG. 2 illustrates generally an example inverting, non-isolated, high-efficiency, thermally-compensated regulator 201. The regulator 201 can include a voltage divider 205 including a zener diode 206 and first and second resistors 207, 208. The voltage divider 205 can be coupled to the output voltage $V_{OUT}$. A bias node 209 of the voltage divider 205 can be coupled to a control node of a transistor 210, such as, but not limited to, a base node of a bipolar junction (BJT) transistor. In certain examples, the transistor 210 can include a gain of about 400. As the output voltage $V_{OUT}$ fluctuates, the impedance of the transistor 210 can vary inversely with the output voltage $V_{OUT}$. In an example, the transistor 210 can provide feedback information 204 and can be coupled to a feedback input of a power supply controller to close a loop of the power supply. In certain examples, the regulator 201 can operate with nominal bias current of about 50 microamps (μA). In certain examples, the zener diode 206, the first resistor 207, and the second resistor 208 can be selected for a particular output voltage, $V_{OUT}$. Table 1 below illustrates particular device selections for various output voltages.

TABLE 1

| Zener Diode 206 Voltage 25° C. @50 uA | Zener Diode 206 Temperature Coefficient mV/° C. @50 uA | Transistor 210 B-E Temperature Coefficient mV/° C. @ 0.5 uA | First Resistor 207 Kohms | Desired Regulator Voltage | Second Resistor 208 Kohms | Regulator Temperature Coefficient mV/° C. | Regulator Temperature Coefficient Error ppm/° C. |
|---|---|---|---|---|---|---|---|
| 6.742 | 2.855 | −2.18 | 11.7 | 8 | 13.54 | −1.831 | −228.8 |
| 8.253 | 4.618 | −2.18 | 11.7 | 9 | 5.72 | 1.382 | 153.6 |
| 9.035 | 5.500 | −2.18 | 11.7 | 10 | 7.45 | 1.944 | 194.5 |
| 10.068 | 6.553 | −2.18 | 11.7 | 12 | 30.53 | −1.282 | −106.8 |
| 13.037 | 9.500 | −2.18 | 11.7 | 15 | 33.41 | 1.131 | 75.4 |
| 15.814 | 11.487 | −2.18 | 11.7 | 18 | 35.99 | 2.639 | 146.6 |
| 14.783 | 10.053 | −2.18 | 11.7 | 18 | 54.82 | −2.286 | −127.0 |
| 17.926 | 13.921 | −2.18 | 11.7 | 20 | 38.17 | 4.669 | 233.5 |
| 19.590 | 15.250 | −2.18 | 11.7 | 24 | 79.96 | −1.750 | −72.9 |

In addition to providing a low power, high efficiency regulator, the example regulator 201 can also improve the temperature drift performance of a power supply. Performance of electrical components, in general, can vary as temperature of the power supply components change. The measure of the change can be represented by a temperature coefficient and the change in a device operating condition can be known as a temperature drift effect. In certain examples, the temperature coefficient of the zener diode 206 and the temperature coefficient of the base-emitter junction of the transistor 210 can be configured to reduce at least a portion of a temperature drift effect of the zener diode and the transistor as well as the combined temperature drift effect of the regulator. The example regulator of FIG. 2 can be temperature compensated via the complimentary temperature coefficients of the zener diode 206 and the base-emitter junction of the transistor 210. In an example, a zener diode for a 24 volt regulator can have a temperature coefficient of about 15 millivolts per degree Celsius (mV/° C.) and the temperature coefficient of the base-emitter junction of a transistor can be about −2.18 mV/° C. The temperature coefficient of the example regulator of FIG. 1 using the zener diode and the transistor can be as low as −1.750 mV/° C. In certain examples, the thermal coefficient of the zener and the transistor junction can be selected such that the zener diode thermal coefficient is substantially equal to the transistor junction thermal coefficient times the ratio of the resistance of the second resistor 208 to the resistance of the first resistor 207. In certain examples, the regulator can include a filter 211 to ensure regulation loop stability. In certain examples, an integrated circuit can include the transistor 210 and the zener diode 206. The transistor 210 and the zener diode 206 can be configured to provide a thermally compensated regulator. In such an example, components external to the integrated circuit, such as the first resistor 207 and the second resistor 208, can be selected to provide a desired output voltage, $V_{OUT}$. In certain examples, the regulator 301 can regulate output current. In certain examples, an upper limit of the output voltage can be determined by the capabilities of the transistor 210. In certain examples, a lower limit of the output voltage can be determined by the zener voltage of the zener diode 206. In certain examples, low voltage regulator can use an light emitting diode (LED) to provide the zener voltage. For example, red LEDs can provide a zener voltage of about 1.65 volts.

In certain examples, the regulator 201 can recursively regulate the current that produces the voltage drop across the zener diode 206, thus, providing additional output voltage $V_{OUT}$ stability.

Figure 3:
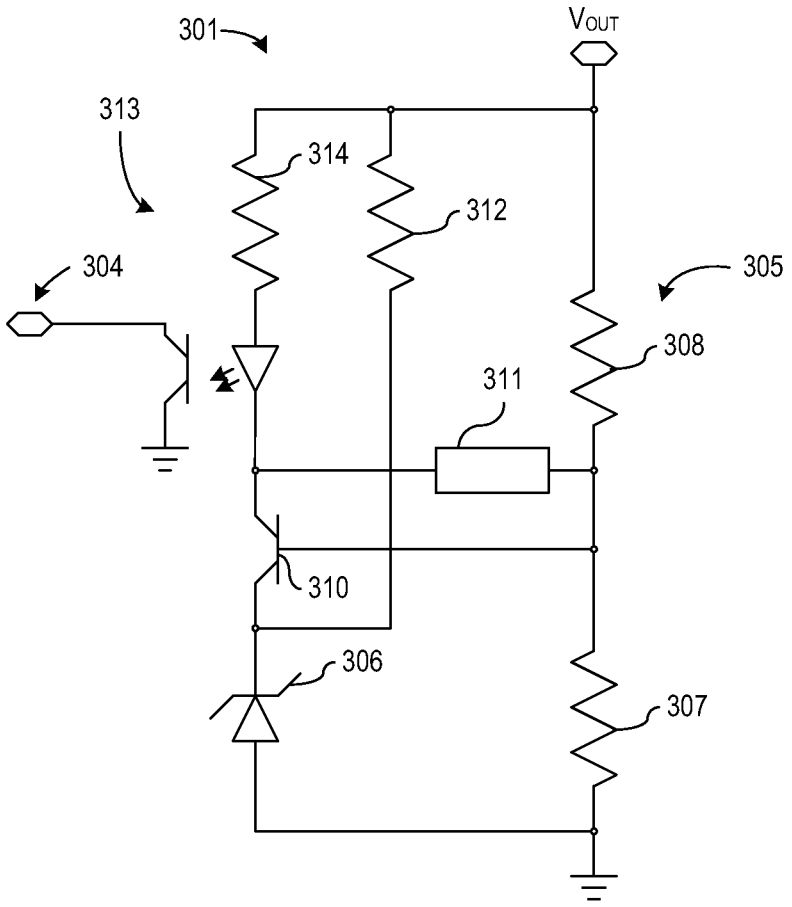
FIG. 3 illustrates generally an example isolated, high-efficiency, thermally-compensated regulator.

FIG. 3 illustrates generally an example isolated, high-efficiency, thermally-compensated regulator 301. The regulator 301 can include a voltage divider 305 including first and second resistors 307, 308, a bias resistor 312, a zener diode 306, a transistor 310, and a feedback optical isolator 313 with a current limit resistor 314. In certain examples, the zener diode 306 can provide a reference voltage at the emitter of the transistor 310 and the voltage divider 305 can provide a representation of the output voltage $V_{OUT}$ at the control node of the of the transistor 310. The transistor 310 can compare the values and provide feedback information 304, including an indication of the output voltage error, using the current of the feedback optical isolator 313. Table 2 includes example values of device characteristics of the example regulator 301 to provide regulation of various values of an output voltage $V_{OUT}$. In certain examples, the output voltage $V_{OUT}$ can be selected from a range including from about 8 volts to about 100 volts.

TABLE 2

| Zener Diode 306 Voltage 25° C. @250 uA | Zener Diode 306 Temperature Coefficient mV/° C. @250 uA | Transitor 310 B-E Temperature Coefficient mV/° C. @ 0.5 uA | First Resistor 307 Kohms | Second Resistor 308 Kohms | Regulator Voltage | Output Temperature Coefficient mV/° C. | Output Temperature Coefficient ppm/° C. |
|---|---|---|---|---|---|---|---|
| 6.103 | 2.013 | −2.18 | 137.0 | 25.5 | 8 | −0.1924 | −24.05 |
| 6.103 | 2.013 | −2.18 | 137.0 | 45.3 | 9 | −0.2163 | −24.03 |
| 6.103 | 2.013 | −2.18 | 137.0 | 66.5 | 10 | −0.2401 | −24.01 |
| 6.103 | 2.013 | −2.18 | 137.0 | 86.6 | 11 | −0.2640 | −24.00 |
| 6.103 | 2.013 | −2.18 | 137.0 | 107.0 | 12 | −0.2878 | −23.99 |
| 6.103 | 2.013 | −2.18 | 137.0 | 127.0 | 13 | −0.3117 | −23.98 |
| 6.103 | 2.013 | −2.18 | 137.0 | 169.0 | 15 | −0.3594 | −23.96 |
| 6.103 | 2.013 | −2.18 | 137.0 | 232.0 | 18 | −0.4310 | −23.94 |
| 6.103 | 2.013 | −2.18 | 137.0 | 267.0 | 20 | −0.4787 | −23.93 |
| 6.103 | 2.013 | −2.18 | 137.0 | 348.0 | 24 | −0.5741 | −23.92 |
| 6.103 | 2.013 | −2.18 | 137.0 | 590.0 | 36 | −0.8603 | −23.90 |
| 6.103 | 2.013 | −2.18 | 137.0 | 845.0 | 48 | −1.1465 | −23.89 |

In certain examples, the output voltage $V_{OUT}$ can be selected, or the various values of the regulated can be selected, using the following general formula:

$$V_{OUT} = V_{REF}\left(1 + \left(\frac{R_1}{R_2}\right)\right),$$

where $V_{REF}$ includes the voltage across the zener diode 306 and the base-emitter junction of the transistor 310, R1 includes the value of the first resistor 307, and R2 includes the value of the second resistor 308.

In addition to providing a low power, high efficiency regulator, the example regulator 301 can also improve the temperature drift performance of a power supply. The example regulator 301 of FIG. 3 is temperature compensated via the complimentary temperature coefficients of the zener diode 306 and the base-emitter junction of the transistor 310. Table 2 illustrates that with the selected zener and transistor, the output temperature coefficient error is about −24 ppm/° C. over the entire output voltage range. In certain examples, the regulator can include a filter 311 to ensure regulator stability. In certain examples, an integrated circuit can include the transistor 310 and the zener diode 306. The transistor 310 and the zener diode 306 can be configured to provide a thermally compensated regulator. In such an example, components external to the integrated circuit, such as the first resistor 307 and the second resistor 308, can be selected to provide a desired output voltage, $V_{OUT}$. In certain examples, the regulator 301 can regulate output current.

In an example, such as for a 12 volt power supply, the current limit resistor 314 can be about 2.2 kohms, and the bias resistor 312 can be about 510 kohms. In such an example, the operating current of the regulator can be about 260 μA.

Figure 4:
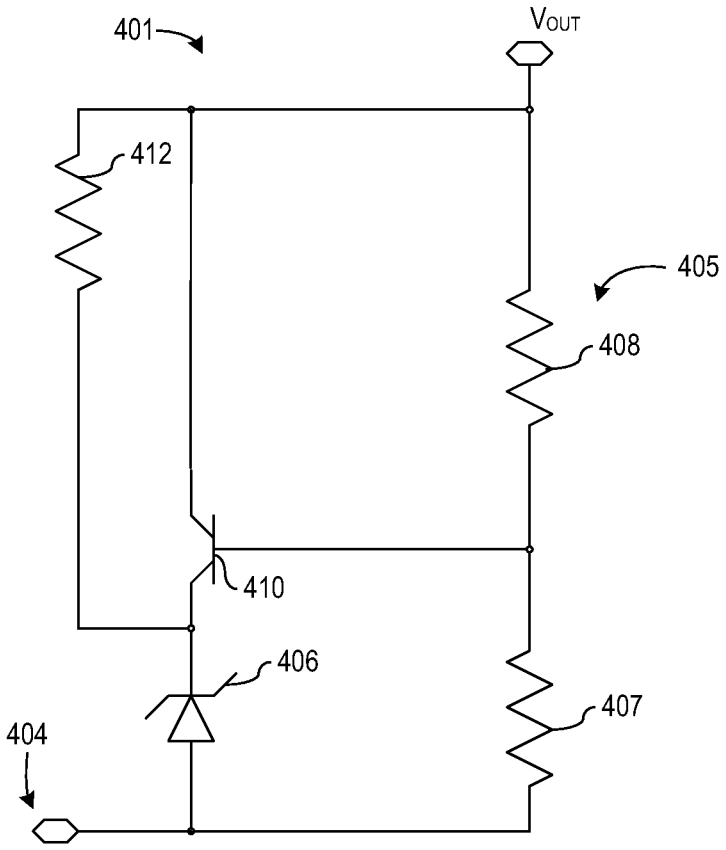
FIG. 4 illustrates generally an example high-efficiency, thermally-compensated, precision zener.

FIG. 4 illustrates generally an example thermally-compensated precision zener diode 420. The thermally-compensated precision zener diode 420 can include a voltage divider 405 including a first resistor 407 and a second resistor 408, a zener diode 406, and a transistor 410. In an example, the transistor 410 compares a representation of an output voltage $V_{OUT}$ to a reference voltage across the zener diode 406. In an example, the thermally-compensated precision zener diode 420 can form at least a portion of a primary regulator. In certain examples, the thermally-compensated precision zener diode 420 can include a third resistor 412 to keep the zener diode conducting current at low voltages. In an example, the thermally-compensated precision zener diode 420 can regulate a 12 volt output voltage $V_{OUT}$. In such an example, the regulator 401 can include a zener diode 406 having a 6.2 breakdown voltage, the first resistor 407 can be about 137 kohms, the second resistor 408 can be about 86.6 kohms and the bias resistor can be about 430 kohms. The operating current of the regulator can be about 60 μA. In addition, the configuration of the zener diode 406 and the base emitter junction of the transistor 410 can provide thermally compensation of the precision zener diode 420. such that the temperature coefficient error of the output voltage $V_{OUT}$ is about −24 ppm/° C. It is understood that other component values and other output voltages can be realized using the thermally-compensated precision zener diode 420 of FIG. 4. For example, the output voltages listed in Table 2 can be realized using the corresponding resistance values for the first and second resistors 407, 408 and the corresponding zener voltage for the zener diode 406. In certain examples, an integrated circuit can include the transistor 410 and the zener diode 406. In such an example, components external to the integrated circuit, such as the first resistor 407 and the second resistor 408 can be selected to provide a desired output voltage, $V_{OUT}$. In an example, the second resistor 408 can be adjustable to allow selection of the output voltage via the adjustable second resistor 408.

Figure 5:
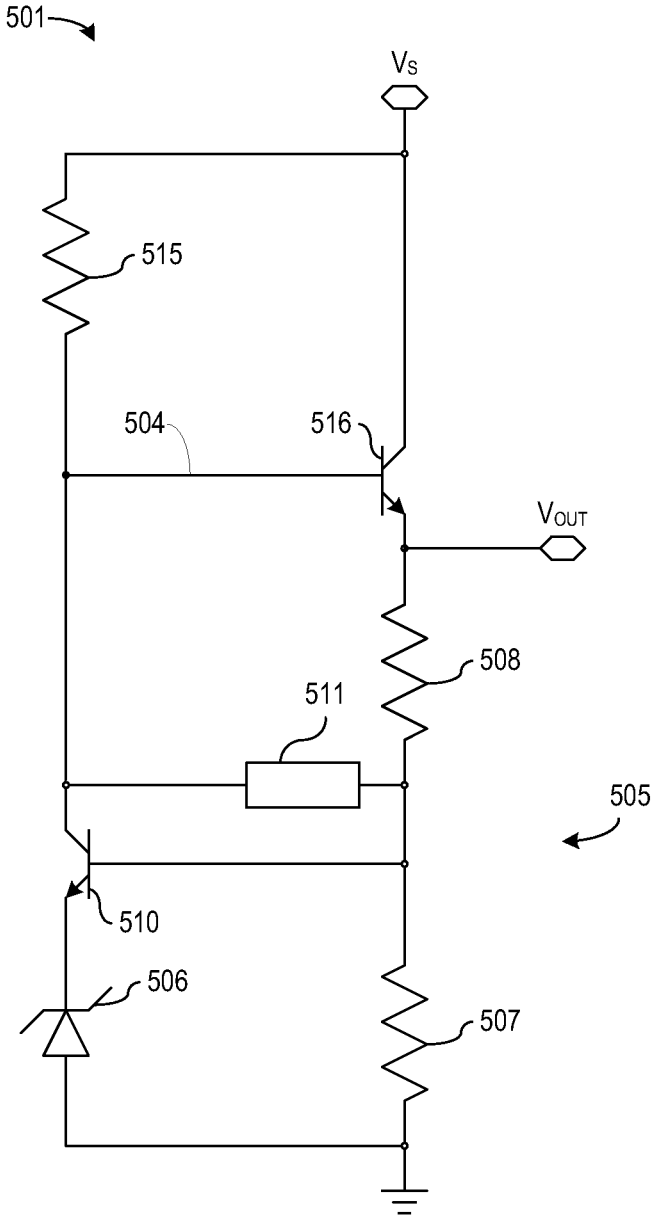
FIG. 5 illustrates generally an example high-efficiency, thermally-compensated, primary regulator.

FIG. 5 illustrates generally an example high-efficiency, thermally-compensated, primary regulator 501. The regulator 501 can include a zener diode 506, a first transistor 510, a pull-up resistor 515, an output pass transistor 516, and a voltage divider 505 including a first resistor 507 and a second resistor 508. In an example, the regulator 501 can include an output pass transistor 516 to receive feedback information 504 from the collector of the first transistor 510 and can modulate the output voltage $V_{OUT}$ using a supply voltage $V_S$. In an example, the feedback information 504 can include information indicative of an error of the output voltage $V_{OUT}$. In certain examples, the output pass transistor 516 can include a high gain transistor such as a Darlington transistor or a metal-oxide-semiconductor field-effect transistor (MOSFET). In certain examples, the output voltage $V_{OUT}$ of the regulator 501 can be used to power other components of a power supply such as the power supply controller. In an example using a bipolar junction transistor, the pull-up resistor 515 can be about 300 kohms and the zener diode 506 can have a breakdown voltage of about 6.8 volts. The first resistor 507 can be about 162 kohms and the second resistor 508 can be about 324 kohms. Such a regulator can provide an output voltage of about 12 volts using about 35 μA. In certain examples, the regulator 501 can include a filter 511 to ensure loop stability. In certain examples, the filter 511 can include a resistor and a capacitor coupled in series between the control nodes of the first transistor 510 and the second transistor 515. In addition to providing a high efficiency regulator, the example regulator 501 of FIG. 5 can provide a thermal compensation. In an example, a zener diode 506, with a zener voltage of about 6.8 volts, can have a temperature coefficient of about 2.658 mV/C. In combination with the first transistor 510, such as a first transistor having a base-emitter temperature coefficient of about −2.18 mV/C, the regulator 501 can have an output temperature coefficient of about 0.72 mV/C or about 60 ppm/° C. for a 12 volt output. In certain examples, an integrated circuit can include the transistor 510 and the zener diode 506. The transistor 510 and the zener diode 506 can be provide with complementary thermal coefficients to provide a thermally compensated regulator. In such an example, components external to the integrated circuit, such as the first resistor 507 and the second resistor 508 can be selected to provide a desired output voltage, $V_{OUT}$. The illustrated examples of FIGS. 2-5 employ a bipolar junction transistor, however, it is understood that other types of transistors can be used to provide a thermally-compensated, zener diode based regulator without departing from the scope of the present subject matter. In certain examples, the regulator 501 can regulate output current such as the current through the output pass transistor 516.

Figure 6:
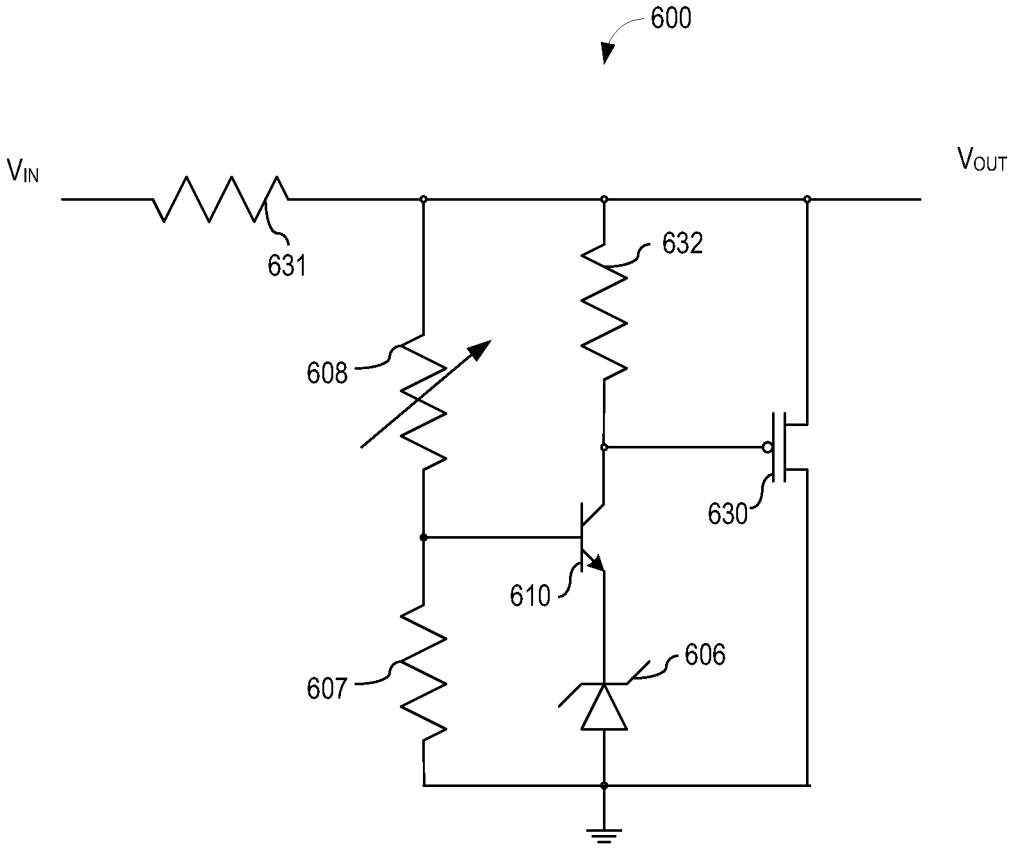
FIG. 6 illustrates generally an example high-current shunt regulator.

FIG. 6 illustrates generally an example high-current shunt regulator 600 including a zener diode 606, transistor 610, a voltage divider 605, a pull-up resistor 632, a current limit resistor 631, and a power transistor 630. In an example, the power transistor can include, but is not limited to, a bipolar transistor or a MOSFET. In certain examples, the voltage divider 605 can include a first resistor 607 and a second resistor 608. In certain examples, the zener diode and junction of the transistor define a reference voltage, $V_{REF}$. The output voltage $V_{OUT}$ can be substantially proportional to the reference voltage by the ratio of the resistance R2 of the second resistor 608 to the resistance R1 of the first resistor 607 such that, $$V_{OUT} = V_{REF}\left(1 + \frac{R2}{R1}\right).$$

In an example, as the output voltage $V_{OUT}$ is pulled higher or lower by changes in the input voltage $V_{IN}$, the voltage divider 605 can exert a corresponding change to $V_{REF}$. In response to the exertion to change $V_{REF}$, the transistor 610 can change voltage at the gate of the power transistor 630 to maintain the $V_{OUT}$ established by the equation above. For example, if the input voltage $V_{IN}$ rises, exerting an increase on $V_{REF}$ and $V_{OUT}$, the power transformer 630 can increase shunt current resulting in more current through the limit resistor 631 thus creating a larger voltage drop across the limit resistor 631 to maintain the desired lower output voltage $V_{OUT}$. If the input voltage $V_{IN}$ decreases, exerting a decrease on the reference voltage $V_{REF}$ and the output voltage $V_{OUT}$, the power transistor 630 can reduce the shunt current resulting in less current through the current limit resistor 631 thus reducing the voltage drop across the limit resistor 631 and maintaining the desired higher output voltage $V_{OUT}$.

In an example, the second resistor 608 can be adjustable such that the output voltage $V_{OUT}$ can be selected via the adjustment of the second resistor 608. In certain examples, the transistor 610 and the zener diode 606 can be selected to have complementary thermal coefficients such that the high-current shunt regulator is thermally compensated. In an example, an integrated circuit can include the transistor 610 and the zener diode 606.

Figure 7:
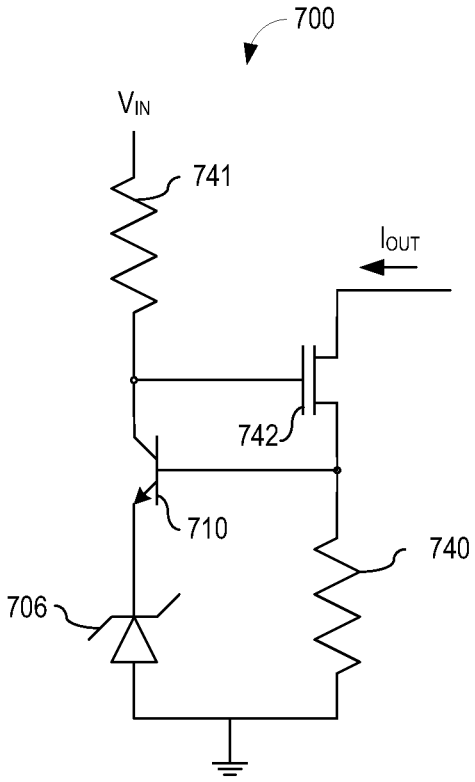
FIG. 7 illustrates generally a thermally compensated precision current source.

FIG. 7 illustrates generally a thermally compensated precision current source 700 that can include a zener diode, a transistor 710, a sense resistor 740, a pull-up resistor 741, and a power transistor 742. IN an example, the power transistor 742 can include, but is not limited to a bipolar transistor or a MOSFET. In certain examples, the output current $I_{OUT}$ can be selected independent of the input voltage $V_{IN}$. In certain examples, selection of the transistor 710 and the zener voltage of the zener diode 706 and the resistance value RS of the sense resistor 740 can determine the value of the output current $I_{OUT}$ such that, $$I_{OUT} = \frac{V_{REF}}{RS},$$

where $V_{REF}$ can be the voltage across the zener diode and the junction of the transistor coupled to the zener diode. The input voltage $V_{IN}$ can disable the precision current source by not maintain a voltage high enough to maintain $V_{REF}$. In an example, the sense resistor 740 can be adjustable such that the output current $I_{OUT}$ can be selected via the adjustment of the sense resistor 740. In certain examples, the transistor 710 and the zener diode 706 can be selected to have complementary thermal coefficients such that the precision current source is thermally compensated. In an example, an integrated circuit can include the transistor 710 and the zener diode 706.

In certain examples, a kit can include an integrated circuit and instructions for making examples circuits such as those illustrated in FIGS. 2-7. In an example, the integrated circuit of the kit can include a transistor and a zener diode having complementary thermal coefficients for making one or more thermally compensated or low-power circuits of FIGS. 2-7.

Additional Notes

In Example 1, a regulator can include a zener diode having a first temperature coefficient, the zener diode configured to couple to a power supply output and to provide at least a portion of a reference voltage, a transistor having a second temperature coefficient, the transistor configured to receive the reference voltage, to receive a representation of the power supply output, and to provide feedback information indicative of an error of the power supply output using the representation of the power supply output and the reference voltage, and wherein the first temperature coefficient and the second temperature coefficient are configured to reduce at least a portion of a temperature drift effect of the zener diode and the transistor.

In Example 2, the regulator of Example 1 optionally includes a first resistor coupled to the power supply output, a second resistor coupled to ground in series with the first resistor, and wherein a control node of the transistor is configured to receive the at least portion of the reference voltage from a node coupled to the first resistor and the second resistor.

In Example 3, the zener diode of any one or more of Examples 1-2 is optionally coupled between the transistor and ground.

In Example 4, the power supply output of any one or more of Examples 1-3 is optionally configured to provide an output current, such as a regulated output current.

In Example 5, the power supply output of any one or more of Examples 1-4 is optionally configured to provide an output voltage, such as a regulated output voltage.

In Example 6, the output voltage, $V_{OUT}$, of any one or more of Examples 1-5 is optionally given by, $$V_{OUT}=V_{REF}(1+R_1/R_2),$$

wherein $V_{REF}$ is the reference voltage, $R_1$ is a resistance value of the first resistor, and $R_2$ is a resistance value of the second resistor.

In Example 7, the zener diode of any one or more of Examples 1-2 is optionally coupled in series with the first resistor and the second resistor.

In Example 8, the power supply output of any one or more of Examples 1-7 is configured to provide an output current, such as a regulated output current.

In Example 9, the power supply output of any one or more of Examples 1-8 is optionally configured to provide an output voltage, such as a regulated output voltage.

In example 10, a ratio of the first thermal coefficient to the second thermal coefficient of any one or more of Examples 1-9 is optionally substantially equal to a ratio of a resistance of the first resistor to a resistance of the second resistor.

In Example 11, the first temperature coefficient of any one or more of Examples 1-10 optionally includes a positive voltage change with increasing temperature and the second temperature coefficient of any one or more of Examples 1-10 optionally includes a negative voltage change with increasing temperature.

In Example 12, the first temperature coefficient of any one or more of Examples 1-10 optionally includes a negative voltage change with increasing temperature and the second temperature coefficient of any one or more of Examples 1-10 optionally includes a positive voltage change with increasing temperature.

In Example 13, an integrated circuit of any one or more of Examples 1-12 optionally includes the transistor and the zener diode.

In Example 14, a power supply can include a power supply controller, power electronics configured to receive an input voltage and to provide an output using command signals from the power supply controller, and a regulator configured receive the output and to provide feedback information to the power supply controller. the regulator can include a zener diode having a first temperature coefficient, the zener diode configured to couple to the output and to provide at least a portion of a reference voltage, a transistor having a second temperature coefficient, the transistor configured to receive the reference voltage, to receive a representation of the output, and to provide the feedback information using the representation of the output and the reference voltage, the feedback information indicative of an error of the output, and wherein the first temperature coefficient and the second temperature coefficient are configured to reduce at least a portion of a temperature drift effect of the zener diode and the transistor.

In Example 15, the power supply controller of any one or more of Examples 1-14 optionally includes a pulse width modulated controller and the power electronics include a power transistor.

In Example 16, the power supply controller of any one or more of Examples 1-5 optionally includes a flyback power supply controller.

In Example 17, the power supply controller of any one or more of Examples 1-16 optionally includes a half bridge driver.

In Example 18, the power supply controller of any one or more of Examples 1-17 optionally includes a full bridge driver.

In Example 19, a method for regulating an output can include providing at least a portion of a reference voltage using an power supply output coupled to a zener diode, the zener diode having a first thermal coefficient, receiving the reference voltage at a transistor coupled to the zener diode, receiving a representation of the power supply output at the transistor, providing feedback information indicative of an error of the power supply output using the representation of the power supply output and the reference voltage, and reducing at least a portion of a temperature drift effect of the zener diode and the transistor using the first temperature coefficient and the second temperature coefficient.

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, although the examples above may have been described relating to NPN devices, one or more examples can be applicable to PNP devices or MOSFET devices in some application. In other examples, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A regulator comprising:

a bipolar junction transistor configured to receive a representation of an output voltage of the regulator at a control node;

a zener diode having a first temperature coefficient, the zener diode configured to provide at least a portion of a reference voltage at an emitter of the bipolar junction transistor;

wherein the bipolar junction transistor includes a second temperature coefficient, the bipolar junction transistor configured to receive the reference voltage and to provide feedback information indicative of an error of the output voltage using the representation of the output voltage and the reference voltage; and wherein the first temperature coefficient and the second temperature coefficient are configured to reduce at least a portion of a temperature drift effect of the zener diode and the transistor.

2. The regulator of claim 1 including;

a first resistor coupled to the output voltage;

a second resistor coupled to ground in series with the first resistor; and wherein a control node of the bipolar junction transistor is configured to receive the at least portion of the reference voltage from a node coupled to the first resistor and the second resistor.

3. The regulator of claim 2, wherein the zener diode is coupled between the bipolar junction transistor and ground.

4. The regulator of claim 3, wherein the output voltage, $V_{OUT}$, is given by, $$V_{OUT}=V_{REF}(1+R_1/R_2),$$

wherein $V_{REF}$ is the reference voltage, $R_1$ is a resistance value of the first resistor, and $R_2$ is a resistance value of the second resistor.

5. The regulator of claim 1, wherein the first temperature coefficient includes a positive voltage change with increasing temperature and the second temperature coefficient includes a negative voltage change with increasing temperature.

6. The regulator of claim 1, wherein the first temperature coefficient includes a negative voltage change with increasing temperature and the second temperature coefficient includes a positive voltage change with increasing temperature.

7. The regulator of claim 1, wherein an integrated circuit includes the transistor and the zener diode.

8. A power supply comprising:

a power supply controller;

a power electronics configured to receive an input voltage and to provide an output using command signals from the power supply controller; and a regulator configured receive the output and to provide feedback information to the power supply controller;

wherein the regulator includes:

a bipolar junction transistor configured to receive a representation of the output of the power supply at a control node;

a zener diode having a first temperature coefficient, the zener diode configured to provide at least a portion of a reference voltage at an emitter of the bipolar junction transistor;

wherein the bipolar junction transistor includes a second temperature coefficient, the bipolar junction transistor configured to receive the reference voltage and to provide feedback information indicative of an error of the output using the representation of the output and the reference voltage; and wherein the first temperature coefficient and the second temperature coefficient are configured to reduce at least a portion of a temperature drift effect of the zener diode and the transistor.

9. The power supply of claim 8, wherein the power supply controller includes a pulse width modulated controller and the power electronics include a power transistor.

10. The power supply of claim 8, wherein the power supply controller includes a flyback power supply controller.

11. The power supply of claim 8, wherein the power supply controller includes a half bridge driver.

12. The power supply of claim 8, wherein the power supply controller includes a full bridge driver.

13. A method for regulating an output voltage, the method comprising:

providing at least a portion of a reference voltage using a zener diode, the zener diode having a first thermal coefficient;

receiving the at least portion of the reference voltage at an emitter of a bipolar junction transistor, the emitter coupled to the zener diode;

receiving a representation of a power supply output voltage at a control node of the bipolar junction transistor;

comparing the representation of the power supply output voltage and the at least portion of the reference voltage using the bipolar transistor to provide feedback information indicative of an error of the power supply output voltage; and reducing at least a portion of a temperature drift effect of the zener diode and the bipolar junction transistor using the first temperature coefficient and the second temperature coefficient.

* * * * *